United States Patent [19]

Kubo

[11] Patent Number: 4,817,954

[45] Date of Patent: Apr. 4, 1989

[54] GOLF SWING TRAINING DEVICE

[76] Inventor: Gerald G. Kubo, 34 Eastbrook Dr., River Edge, N.J. 07661

[21] Appl. No.: 103,349

[22] Filed: Oct. 1, 1987

[51] Int. Cl.[4] ..... A63B 69/36

[52] U.S. Cl. ..... 273/191 R; 273/186 C; 273/183 B

[58] Field of Search ..... 273/183 B, 186 R, 186 A, 273/188 R, 189 R, 186 C, 190 R, 191 R, 192; 224/184, 197, 201, 271, 917, 922

[56] References Cited

U.S. PATENT DOCUMENTS

| | | | |
|---|---|---|---|
| 2,445,839 | 7/1948 | Newman et al. | 273/183 B |
| 2,462,955 | 3/1949 | Glancey | 273/186 C |
| 2,506,685 | 5/1950 | Sadloski et al. | 224/197 |
| 3,000,261 | 9/1961 | Frenkel | 273/35 A |
| 3,109,244 | 11/1963 | Trifaro et al. | 273/35 R |
| 3,767,204 | 10/1973 | Bryson | 273/183 B |
| 3,820,781 | 6/1974 | Kane | 273/35 R |
| 3,870,317 | 3/1975 | Wilson | 273/188 R |
| 3,917,278 | 11/1975 | Steinman, Jr. | 273/183 E |
| 3,937,473 | 2/1976 | Blasi | 273/183 B |
| 3,940,144 | 2/1976 | Dickie | 273/183 B |
| 4,061,340 | 12/1977 | Husted | 273/189 R |
| 4,213,605 | 7/1980 | McPeak | 224/201 X |
| 4,239,228 | 12/1980 | Norman et al. | 273/189 R |
| 4,449,708 | 5/1984 | Humphrey | 273/186 A |

FOREIGN PATENT DOCUMENTS

| | | | |
|---|---|---|---|
| 522814 | 6/1940 | United Kingdom | 273/191 R |

*Primary Examiner*—George J. Marlo

*Attorney, Agent, or Firm*—Anthony J. Casella; Gerald E. Hespos

[57] ABSTRACT

A golf swing training device is provided comprising a head-piece having an open-end slot dimensioned to receive the shaft of a golf club, and further comprising a support for adjustably positioning the head-piece at a selected location relative to the golfer's shoulder. The head-piece may be adjusted by a golf pro on the student to guide the golf club shaft into the preferred position at the top of the backswing.

7 Claims, 3 Drawing Sheets

GOLF SWING TRAINING DEVICE

BACKGROUND AND SUMMARY OF THE INVENTION

My invention is a unique golf swing training device in which means are provided for a golfer to accurately guide his golf club into the optimum top-of-the-backswing position, before he completes his downswing through the ball. This version of the G-SOT GUIDE is designed for the full swing with either the iron or wood clubs.

The objectives of this invention are to provide the following:

(a) A pre-set physical groove or pointer indicator which will serve as a target for the top-of-the-backswing position to bracket the adjustments necessary for those golfers seeking a repeating swing, and/or (b) a pre-set platform from which to launch the downswing for those who wish to simplify their golf swing by concentrating on the most important segment—the downswing, by starting down from the correct top-of-the-backswing position.

The position of the club at the top of the backswing is very important to the execution of a good golf swing. To insure a repeating swing, it is obvious that the golfer must be able to swing the golf club from the same "slot" at the start of the downswing.

The "right" position of the golf club at the top-of-the-backswing will vary for each golfer. There are the obvious differences in the physique of the individuals (height, weight, fitness, age, etc.), the normal stance and the degree of shoulder turn taken by each golfer as well as the difference in the length of each of the normal array of golf clubs which might be used. The experts have attempted to define this position and have expressed it in a number of ways. For example, Ben Hogan in his book "The Modern Fundamentals of Golf" writes that the ideal position of the golf plane can be defined by a hypothetical pane of glass inclined from the ball on the ground to the top of the shoulders when in the address position. He claims that the hands and the club shaft should be parallel to and located just under this plane at the top of the backswing. Even among the touring professionals, there are some who are "flat", some who are "upright", with the others somewhere between the two extremes.

The golf professional or instructor would be able to establish this "slot" for each student. A do-it-yourself golfer could also do it by a process of trial and error, if he has a suitable device such as the G-Slot Guide herein described.

The proposed "G-Slot Guide" is the is the answer to the prayers of all golfers. The Guide is an adjustable device which would be individually set up and which would be calibrated by suitable means to recapture this ideal position at any future time. In general terms this Guide is a physical embodiment of a computer memory of a 3-dimensional groove in space which will reproduce the proper position of the golf club at the top of the backswing for each golfer.

This invention is made up of a combination of elements and in certain parts of novel construction included therein, in order to obtain the desired results. This version is basically supported from the right shoulder. A right-handed golfer, either male of female, is assumed for convenience.

A fuller appreciation of my invention is best obtained from a detailed description of the device embodying the various features of my invention. A description will be given in connection with the accompanying drawings showing such preferred construction. The features forming the invention will then be specifically pointed out in the claims. Similar reference numbers will designate corresponding parts thoroughout the several figures of the drawings.

BRIEF DESCRIPTION OF THE DRAWINGS

In the embodiments of the invention shown in FIG. 1 to FIG. 8 inclusive.

DETAILED DESCRIPTION OF THE PREFERRED EMBODIMENTS

Figure 3:
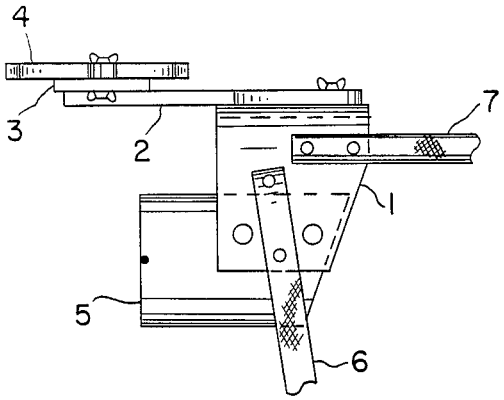
FIG. 3 is a plan view of the device as seen from above.
Figure 1:
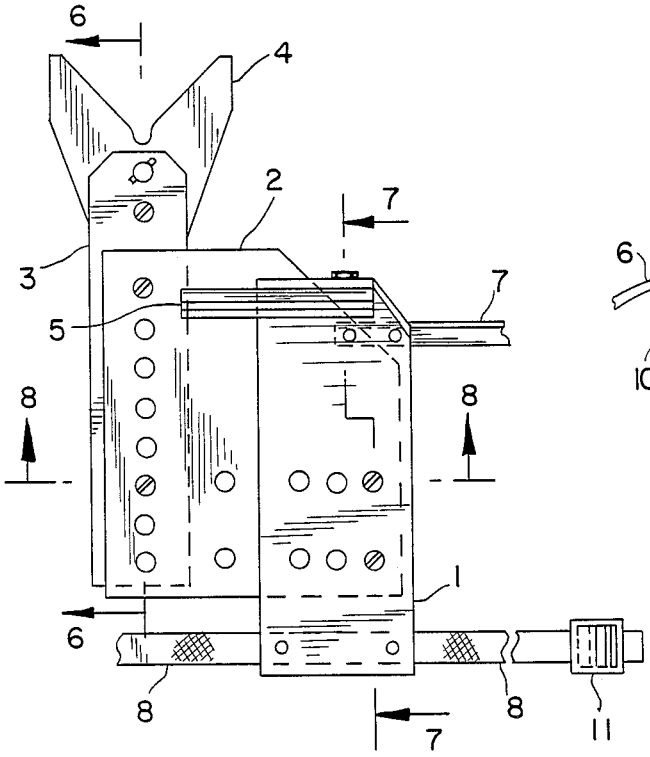
FIG. 1 is an elevation view of my golf swing training device drawn for the right shoulder of a right-handed golfer shown as it would appear from the front.
Figure 2:
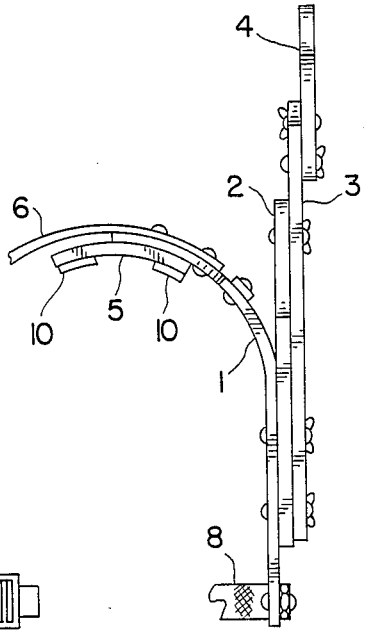
FIG. 2 is the same device seen from the right side, showing the curved support which would rest on the top of the shoulder.

A curved sheet of plastic or similar material, formed by the judicious use of heat is molded to fit over the shoulder and rest on a portion of the upper back, is provided to support the G-Slot groove assembly and a set of straps which secures the curved support plate to the body. This plate is identified as part 1. A supplementary curved sheet 5 is attached to the support plate 1 to extend the shoulder support area out to the "point-of-the-shoulder". This point-of-the-shoulder will be the key reference point from which the horizontal coordinate (x) and the vertical coordinate (y) position of the G-slot groove will be recorded.

A bracket plate 2 with a network of holes spaced at one (1) inch in both the x and y coordinate directions is attached to the support plate 1 with a minimum of two (2) suitable stove bolts.

A vertical stem plate 3 with a series of holes at one (1) inch spacing is tentatively attached to the bracket plate 2 with minimum of two (2) suitable stove bolts. The position of this stem plate 3 in the x-direction is to coincide with the golfer's club shaft position at the top-of-the-backswing. The head-piece 4 with a V-shaped slot is bolted to the top of the stem plate. The bottom of the V-shaped slot is to coincide with the lowest point of the golf club shaft at the top of the backswing.

To secure the curved shoulder-plate to the golfer's right shoulder a pair of short supplementary Velcro strips with adhesive backing are placed on the shoulder of the outer garment. The "hard" surface will engage the "soft" surface of the matching Velcro strips 10, secured to the underside of the curved shoulder plate 5. Next the flexible straps are used to secure the support-plate 1 to the body. First, the two halves of the horizontal strap 8 are extended outward then brought forward under the arm pits and joined at the front of the chest by means of the cam-lockable buckle 11 provided.

The free end of strap 6 is draped over the shoulder and drawn diagonally across the chest, passed under the belt worn by the golfer and then fastened to the cam-lockable buckle. The free end of strap 7 is routed around the back of the neck, then diagonally across the chest, passed under the belt, then secured to its cam-lockable buckle. Straps 6 and 7 will form an X in front of the chest. It will be necessary to use this "cross-the-heart" configuration for the straps when women golfers use this device, for obvious reasons.

The straps are adjusted as required so that the designated "point of shoulder" on the curved-shoulder support is positioned directly over the golfer's shoulder point.

The teaching pro would work with the golfer to establish the most desirable top-of-the-backswing position of the golf club and therefor the G-Slot groove. The conventional method would be to take the normal take-away followed by the natural cocking of the wrists. Another recommended method is to bring the golf club directly in front of the body so that the shaft is vertical. Then the golfer is asked to turn his shoulder 90 degrees to the right. The club will be in an acceptable top-of-the-backswing position.

The teaching pro would be able to decide on a reasonable approximation of the G-Slot position in terms of the X (horizontal) and y (vertical) coordinates for each golfer, measured from the origin at the point of the shoulder. Then the stem plate 3 with the head-piece 4 attached can be connected to the bracket plate 2 in such a way as to match the x and y coordinates. Next a final check would be made with the golfer taking his normal backswing. The teaching pro would make whatever adjustments that he deemed advisable.

If the approach that the clubshaft makes to the V-shaped slot requires it, the head-piece 4 can be rotated about the top connection bolt in increments of 22½ degrees without changing the x and y coordinates of the G-Slot appreciably.

In the event that the learning golfer has a tendency to start his downswing with his arms too early i.e. casting from the top, a modified head-piece can be substituted. As shown in FIG. 4B, this modification consist of a spring-loaded restraint 14 inserted in the semi-circular groove and secured to the bottom with a suitable adhesive. This restraint is designed to accomodate the club shaft when it is at the top-of-the-backswing position.

The golfer would be encouraged to keep his club shaft "still" within the spring-loaded restraint as long as possible. After the body is well into the weight shift back to the left, then the spring restraint will be overcome and the club shaft will be released. The resistance of the spring-loaded restraint can be varied and would be classified as weak, moderate, or strong to suit the individual case.

The afore-mentioned G-slot configuration is primarily adopted to the golfer who desires to use the G-Slot Guide as a launching platform for the downswing to follow. This is the new three-phase swing which has a correction phase between the backswing phase and the downswing phase. The golfer knows that he is starting from the correct top-of-the-backswing position. All he has to think about is to make his downswing as error-free as possible. Thus it becomes possible to simplify the theorectically-complicated golf swing to the basic requirement of making a smooth swing through the ball.

This approach is especially suited to the problem faced by many senior citizens who upon retiring at an advanced age desires to join his friends on the golf course. He has two strikes against him at the start. First, he is not as agile and supple as he was as a teen-ager and second he does not have the time necessary to devote to mastering the complex series of coordinated movements required for a good golf swing. The use of the G-Slot Guide as a training device on the practice tee will substantially reduce the time required to learn an adequate repeating swing. The use of the three-phase-swing without the G-Slot Guide follows naturally so that the new golfer will soon be competitive with his friends who have been golfing for a long time.

Another use of the G-Slot concept is as a target rather that as a platform. This golfer wishes to use the conventional continuous backswing-downswing sequence. He would have the top-of-the-backswing position set when he was swinging satisfactorily. With the G-Slot Guide he will know what his ideal x-and y-coordinates should be. When he goes into a slump and his swing has wandered off the groove, he can check to see if it is his top-of-the-backswing position that needs to be corrected. For this golfer a modified version of the GSlot Guide is recommended.

Figure 4:
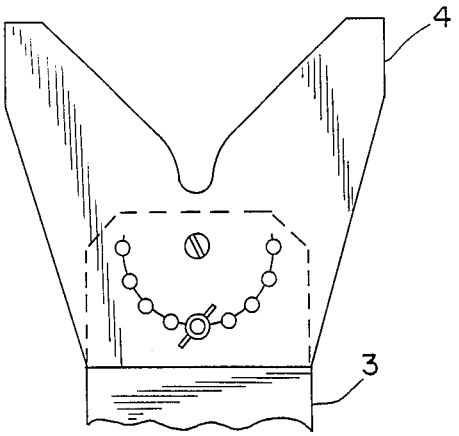
FIG. 4 shows a front elevation of the standard head-piece 4.
Figure 4A:
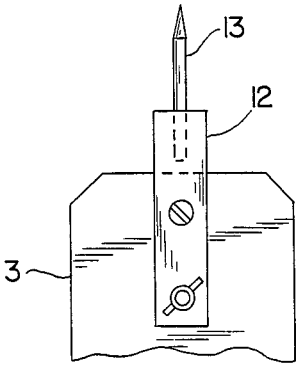
FIG. 4A and FIG. 4B are proposed modifications of the standard head-piece as explained later.
Figure 5:
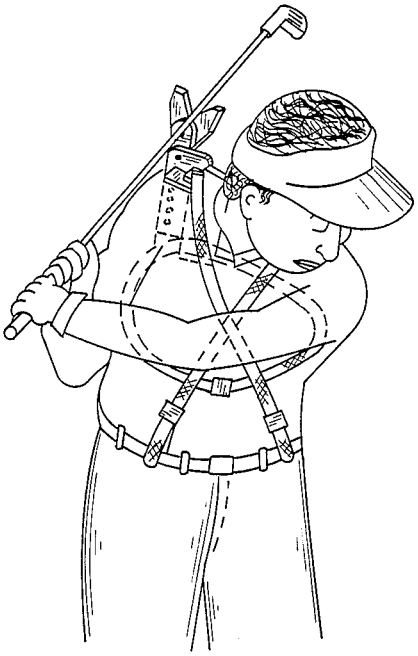
FIG. 5 shows pictorially how the G-Slot Guide is supported by the right shoulder and strapped to the body of the golfer who has a golf club at the top of the backswing with the shaft of the club in the V-shaped slot.
Figure 4B:
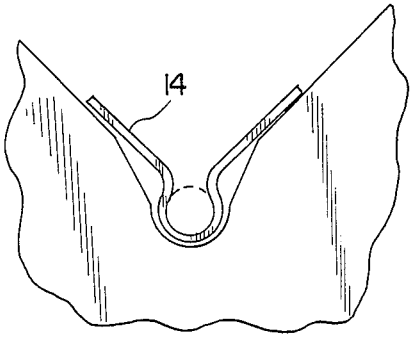
Figure 6:
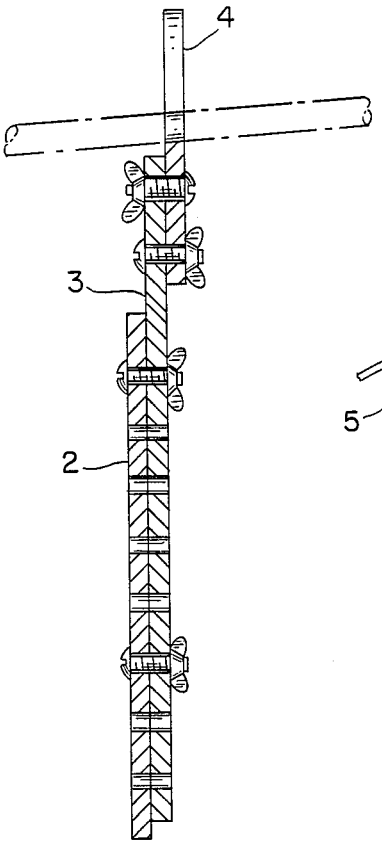
FIG. 6 is a sectional view taken on line 6—6 of FIG. 1.
Figure 7:
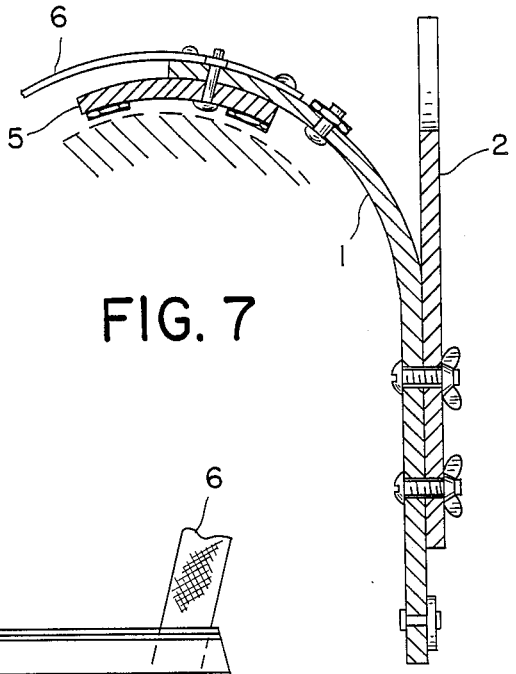
FIG. 7 is a sectional view taken on line 7—7 of FIG. 1.
Figure 8:
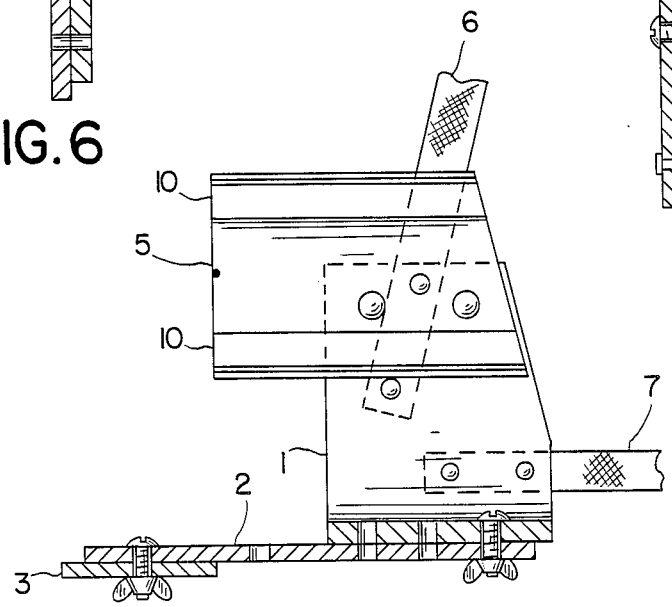
FIG. 8 is a sectional view taken on line 8—8 of FIG. 1.

In this modification shown in FIG. 4A, the V-shaped head-piece 4 is replaced by a vertical holder 12 with a flexible pointer 13 at its upper end. The pointer should be set so that in actual use the golf shaft will not actually make contact with the pointer. However an observer can readily estimate whether the golf shaft was to the inside, in line with, or to the outside of the pointer and the magnitude of the deviation. The golfer will use this information to correct his backswing until he is satisfied that he has recaptured his grooved backswing.

While I have shown the preferred embodiments of my invention, it is to be understood that changes in the size, shape, and arrangements may be made without departing from the spirit of the invention or the scope of the appended claims.

What I desire to claim as new and secure by Letters Patent of the United States is:

1. A golf swing training device enabling a golfer to guide a golf club shaft into a preselected position at the top of the golfer's backswing from which the golfer may commence a down-swing, said device comprising:

a head-piece comprising an open ended generally V-shaped slot having a bottom dimensioned to receive the shaft of the golf club; and adjustable support means mounted to the head-piece for secure but removable mounting to the shoulders and upper back of the golfer and for adjustably positioning the head-piece along a first axis extending generally between the golfer's shoulders and a second axis extending generally orthogonal to the first axis, such that the bottom of the V-shaped slot of the head-piece is adjustably positioned into the preselected preferred position at the top of the golfer's backswing, said V-shaped slot guiding the golf club shaft into the preselected position at the top of the golfer's backswing, and permitting the golfer to commence a down-swing therefrom.

2. A golf swing training device as in claim 1 wherein the head-piece is angularly adjustable relative to said support means.

3. A golf swing training device as in claim 1 wherein the support means comprises a curved shoulder-plate for mounting on the golfer's shoulder.

4. A golf swing training device as in claim 3, wherein the support means further comprises a vertical stem plate mounted for selectively adjustable movement relative to the remainder of the support means, said head-piece being connected to the vertical stem plate of the support means.

5. A golf swing training device as in claim 4 wherein said support means further comprises a bracket plate adjustably mounted to the shoulder-plate, said vertical stem plate being adjustably mounted to the bracket plate.

6. A golf swing training device as in claim 5, wherein the head-piece is angularly adjustable relative to the vertical stem plate.

7. A golf swing training device as in claim 1 wherein the support means comprises straps for the secure but removable mounting of the support means to the golfer.

* * * * *